US008424171B2

(12) United States Patent
McCracken et al.

(10) Patent No.: US 8,424,171 B2
(45) Date of Patent: Apr. 23, 2013

(54) INVERTED T-SHAPED ENDSTOPS FOR RECLOSABLE PACKAGE

(75) Inventors: Kenny E. McCracken, Lawrenceville, GA (US); David C. Wallace, Lilburn, GA (US); Eric P. Plourde, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 1035 days.

(21) Appl. No.: 11/807,960

(22) Filed: May 31, 2007

(65) Prior Publication Data

US 2008/0298726 A1 Dec. 4, 2008

(51) Int. Cl.
*B65D 65/08* (2006.01)

(52) U.S. Cl.
USPC ..... 24/436; 24/400; 24/427; 383/64

(58) Field of Classification Search ..... 428/99, 428/100; 24/436, 439, 400, 427; 156/66, 156/73.1; 383/64
See application file for complete search history.

(56) References Cited

U.S. PATENT DOCUMENTS

| | | | | |
|---|---|---|---|---|
| 3,790,992 | A * | 2/1974 | Herz | 24/400 |
| 5,067,208 | A * | 11/1991 | Herrington et al. | 24/400 |
| 5,088,971 | A * | 2/1992 | Herrington | 493/203 |
| 5,131,121 | A * | 7/1992 | Herrington et al. | 24/436 |
| 5,405,478 | A * | 4/1995 | Richardson et al. | 156/308.4 |
| 5,448,807 | A * | 9/1995 | Herrington, Jr. | 24/399 |
| 5,482,375 | A * | 1/1996 | Richardson et al. | 383/64 |
| 5,664,299 | A * | 9/1997 | Porchia et al. | 24/400 |
| 6,287,001 | B1 | 9/2001 | Buchman | |
| 6,569,368 | B2 * | 5/2003 | Machacek | 264/155 |
| 6,686,005 | B2 * | 2/2004 | White et al. | 428/35.2 |
| 6,968,604 | B2 * | 11/2005 | Crevier | 29/408 |
| 6,974,256 | B2 * | 12/2005 | Kinigakis et al. | 383/64 |
| 6,981,936 | B2 * | 1/2006 | Plourde et al. | 493/214 |
| 7,017,240 | B2 * | 3/2006 | Savicki | 24/387 |
| 7,040,809 | B2 * | 5/2006 | Pokusa | 383/64 |
| 7,305,742 | B2 * | 12/2007 | Anderson | 24/400 |
| 7,347,908 | B2 * | 3/2008 | Share et al. | 156/73.1 |
| 7,364,362 | B2 * | 4/2008 | Schneider et al. | 383/61.2 |
| 7,409,750 | B2 * | 8/2008 | Machacek | 24/30.5 R |
| 2003/0213830 | A1 * | 11/2003 | Crevier | 228/2.1 |
| 2004/0066984 | A1 | 4/2004 | Yi Li | |
| 2004/0086206 | A1 | 5/2004 | Tomic | |
| 2005/0281490 | A1 * | 12/2005 | Schneider et al. | 383/61.2 |
| 2006/0115187 | A1 | 6/2006 | Ausnit et al. | |
| 2009/0205278 | A1 * | 8/2009 | Lynch et al. | 52/309.13 |

FOREIGN PATENT DOCUMENTS

FR 2 761 956 A 10/1998

* cited by examiner

*Primary Examiner* — Robert J Sandy
*Assistant Examiner* — Rowland D Do
(74) *Attorney, Agent, or Firm* — McCarter & English, LLP

(57) ABSTRACT

A length of flanged zipper material for reclosable packages or bags is provided with inverted T-shape endstops wherein the zipper profiles are crushed and the flanges are fused together. The reclosable packages or bags are separated at the mid-point of the inverted T-shaped endstops thereby forming L-shaped and reversed L-shaped endstops. The zipper flanges are fused together in the lower cross elements of the endstop thereby providing an area for the slider to be placed wherein the forces from distension of the package or bag walls are unlikely to exert forces to separate the slider from the zipper. This is particularly applicable to slider zippers wherein the flanges are attached to or substantially co-planar with the exterior sidewalls of the interlocking elements of the zipper profiles.

3 Claims, 5 Drawing Sheets

INVERTED T-SHAPED ENDSTOPS FOR RECLOSABLE PACKAGE

BACKGROUND OF THE INVENTION

1. Field of the Invention

The present invention relates to reclosable packages or bags and the slider zippers used in the construction thereof. More particularly, the present invention relates to reclosable packages, and slider zippers used in the construction thereof, wherein the flanges of the slider zipper are attached to, or are in the same plane as, the outside faces of the zipper profile and wherein inverted T-shaped endstops are formed on lengths of zipper material, thereby resulting in L-shaped endstops at the ends of the zipper segments.

2. Description of the Prior Art

In the prior art of reclosable packages or bags for consumer goods, slider operated zippers are well-developed and satisfactory for their intended purpose in many ways. Typically, the zippers for such reclosable packages or bags are constructed and arranged so that the flanges of the zipper are inwardly offset from the exterior side surfaces of the reclosable interlocking profiles of the zipper (see FIG. 1). This provides a horizontal surface for the feet of the slider to engage securely, making it difficult to force the slider from the profiles, even when the sides of the package or bag are distended so as to force the zipper open.

However, if the zipper includes flanges which are co-planar with the reclosable interlocking profiles (see FIG. 2), or if the flanges are attached to the outside of the zipper profiles, forces which distend the package or bag will tend to force the slider from the profiles, particularly when the sides of the package or bag are distended so as to force the zipper open.

OBJECTS AND SUMMARY OF THE INVENTION

It is therefore an object of the present invention to provide a reclosable package or bag, and the zipper used in the manufacture thereof, wherein the zipper flanges may be co-planar or attached to the outside of the zipper profiles, while maintaining a secure engagement of the slider to the zipper when the sides of the package or bag are distended so as to tend to force the zipper open.

This and other objects are attained by forming inverted T-shaped endstops on a length of flanged zipper material at package-width intervals (or intervals corresponding to the desired length of the subsequent zipper segment). The length of zipper material would subsequently be separated at the mid-point of the T-shaped endstops to provide zipper lengths for individual packages or bags.

The slider is inserted onto the zipper profile, typically either before or during manufacture of the reclosable package or bag. When the package or bag is open, the slider can be retracted to a position above the cross element of the endstop, thereby preventing or minimizing the prying forces of the package or bag walls against the slider.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
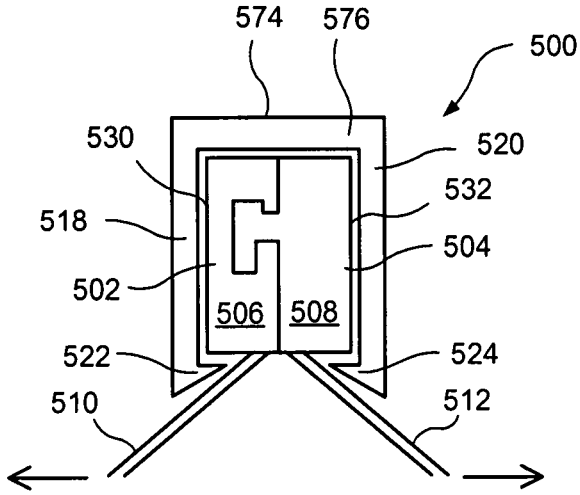
F I G. 1 PRIOR ART
FIG. 1 is a cross-sectional view of a prior art slider zipper wherein the flanges are inwardly offset from the exterior side surfaces of the reclosable interlocking profiles of the zipper.

Referring now to the drawings in detail, wherein like numerals indicate like elements throughout the several views, one sees that FIG. 1 is a view of a prior art zipper 500 comprising first and second interlocking profiles 502, 504, including respective first and second interlocking elements 506, 508 and first and second flanges 510, 512. First and second flanges 510, 512 are sealed to respective first and second walls (not shown) of a reclosable package (not shown). Slider 514 includes top wall 516 and downwardly extending sidewalls 518, 520 which terminate in respective inwardly extending engaging feet 522, 524. First and second flanges 510, 512 are inwardly offset from the respective exterior side faces 530, 532 of respective interlocking elements 506, 508 so that when the filled reclosable package (not shown) is opened thereby urging the first and second flanges 510, 512 into the illustrated distended angle, the feet 522, 524 of the slider 514 remain engaged to the respective first and second interlocking elements 506, 508 of the zipper 500.

Figure 2:
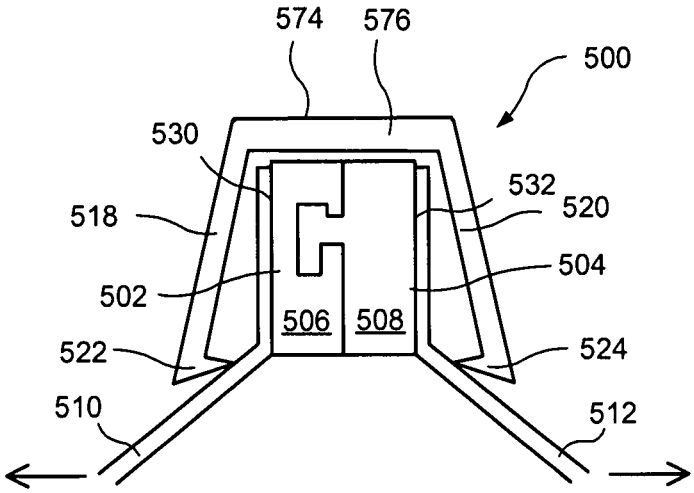
F I G. 2 PRIOR ART
FIG. 2 is a cross-sectional view of a prior art slider zipper wherein the flanges are attached to the exterior side surfaces of the reclosable interlocking profiles of the zipper, illustrating how the distension of the package or bag walls can pry the slider from the zipper.

In FIG. 2, however, the first and second flanges 510, 512 are attached to the respective exterior side faces 530, 532 of the respective first and second interlocking profiles 502, 504. In this configuration, opening the filled reclosable package urges the first and second flanges 510, 512 into the illustrated distended angle, so that the feet 522, 524 of the slider 514 can be pried and separated form the first and second interlocking elements 506, 508 of the zipper 500.

Figure 3:
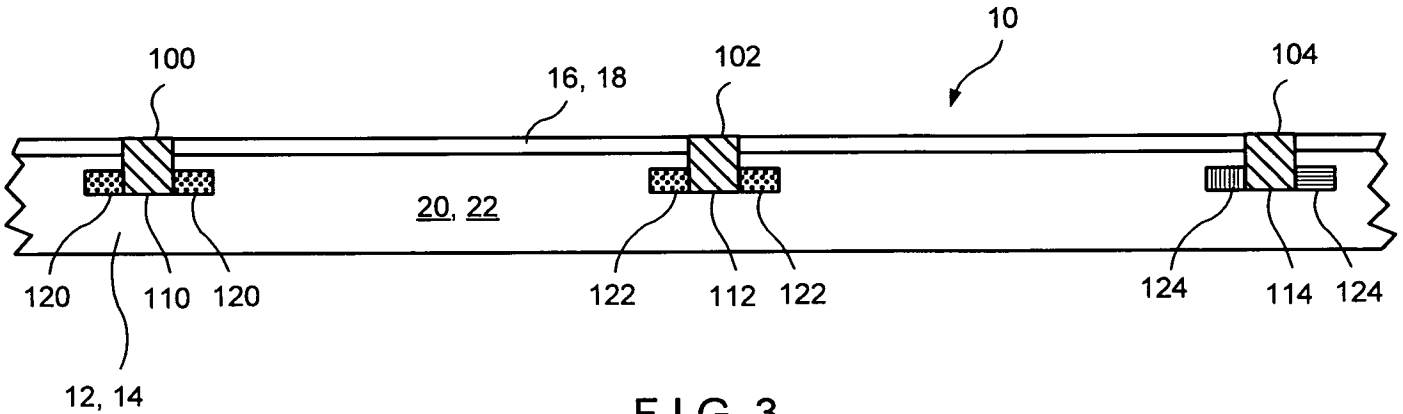
FIG. 3 is a side plan view of a length of zipper material wherein a series of the inverted T-shaped endstops are formed prior to the insertion of the sliders.
Figure 4:
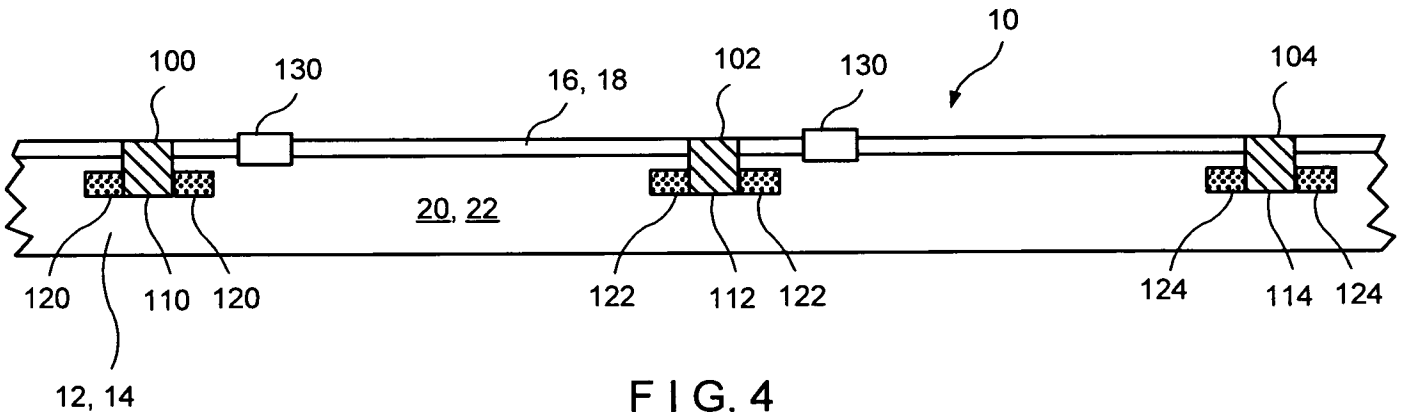
FIG. 4 is a side plan view of a length of zipper material wherein a series of the inverted T-shaped endstops are formed. Sliders are also illustrated, which may be inserted before or after the formation of the inverted T-shaped endstops.

FIGS. 3 and 4 illustrate a length of flanged zipper material 10 with a series of inverted T-shaped endstops 100, 102, 104. Length of flanged zipper material 10 includes first and second interlocking profiles 12, 14 with respective first and second interlocking elements 16, 18 and respective first and second flanges 20, 22 as is known in the prior art.

Inverted T-shaped endstops 100, 102, 104 are formed in the length of flanged zipper material 10 at package length intervals, or at least at intervals corresponding to the desired length of the subsequent zipper segment. The inverted T-shaped endstops 100, 102, 104 include respective stems 110, 112, 114 (perpendicular to the first and second interlocking elements 16, 18) and respective lower cross elements 120, 122, 124 (parallel to and separated from first and second interlocking elements 16, 18) and are formed by an inverted T-shaped anvil and/or horn (not shown) which, in the area of the stems 110, 112, 114 crushes the first and second interlocking elements 16, 18 of the respective first and second interlocking profiles 12, 14 and fuses the first and second flanges 20, 22 together. In the lower cross elements, the first and second flanges 20, 22 can be fused together by a series of dimples as illustrated in lower cross elements 120, 122, or can fused together in a series of fuse lines as illustrated in lower cross elements 124 of FIG. 3. The leftward lower cross element 124 of FIG. 3 is illustrated with vertical fuse lines while the rightward lower cross element 124 is illustrated with horizontal fuse lines. However, it is envisioned that the lower cross elements could be fused together with fuse lines going in any direction or with a large number of equivalent fuse line patterns.

FIG. 3 is illustrated without sliders 130. FIG. 4 is illustrated with sliders 130 which may be inserted before or after, or even substantially simultaneously with, the formation of inverted T-shaped endstops 100, 102, 104.

Figure 5:
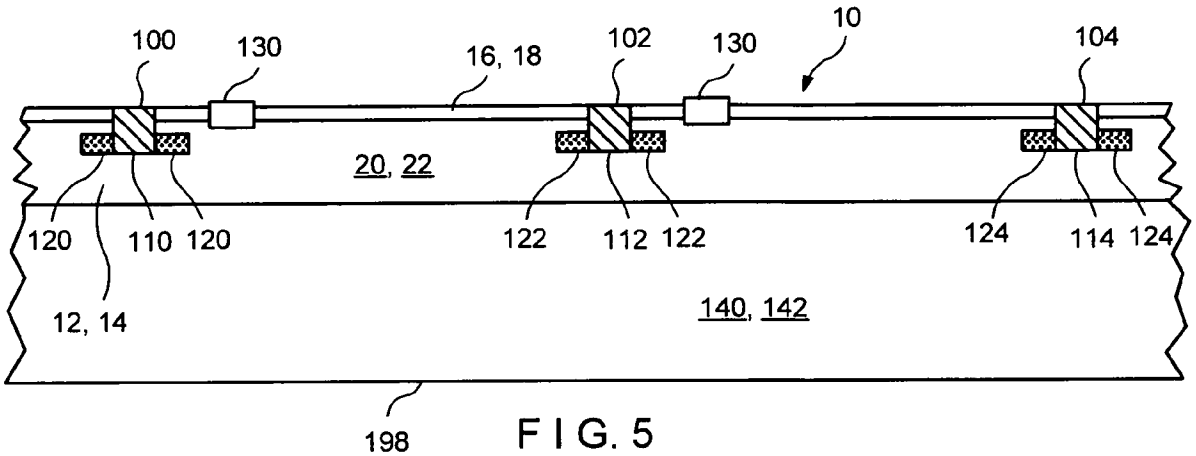
FIG. 5 is a side plan view of the length of zipper material with a series of inverted T-shaped endstops, sealed to film or web for the formation of reclosable packages or bags.

FIG. 5 illustrates length of zipper material 10, with the sliders 130 inserted and the front and rear package or bag walls 140, 142 attached to respective first and second flanges 20, 22. Bottom seal 198 attaches the bottom edges of package or bag walls 140, 142 to each other. Alternatively, a fold may be substituted for bottom seal 198 whereby front and rear package or bag walls 140, 142 are formed from a single sheet of web or film. The configuration of FIG. 5 is typically done as part of a form-fill-and-seal (FFS) manufacturing process, but is adaptable to other manufacturing processes for reclosable packages.

Figure 6:
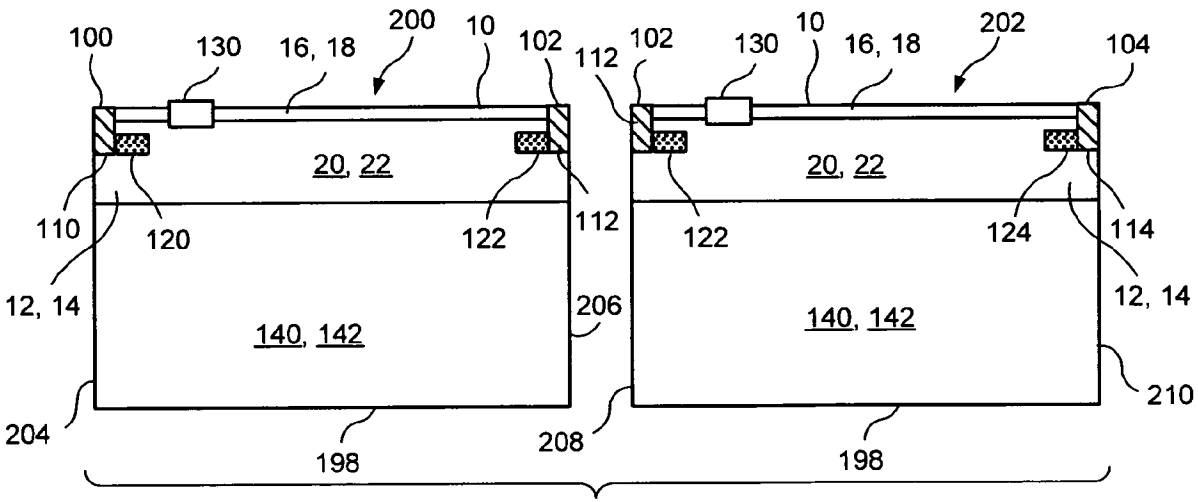
FIG. 6 is a side plan view of two adjacent reclosable packages or bags, subsequent to the separation of the packages or bags at the mid-point of the inverted T-shaped endstops.

FIG. 6 illustrates adjacent reclosable packages or bags 200, 202 which are formed by separating or cutting the length of zipper material 10 and attached package or bag walls 140, 142 of FIG. 5 at package-width intervals at the mid-point of inverted T-shaped endstops 100, 102, 104 (thereby forming an L-shaped endstop and a reversed L-shaped endstop on each segment of zipper 10) and forming vertical side seals 204, 206, 208, 210 between the front rear package or bag walls 140, 142.

Figure 7:
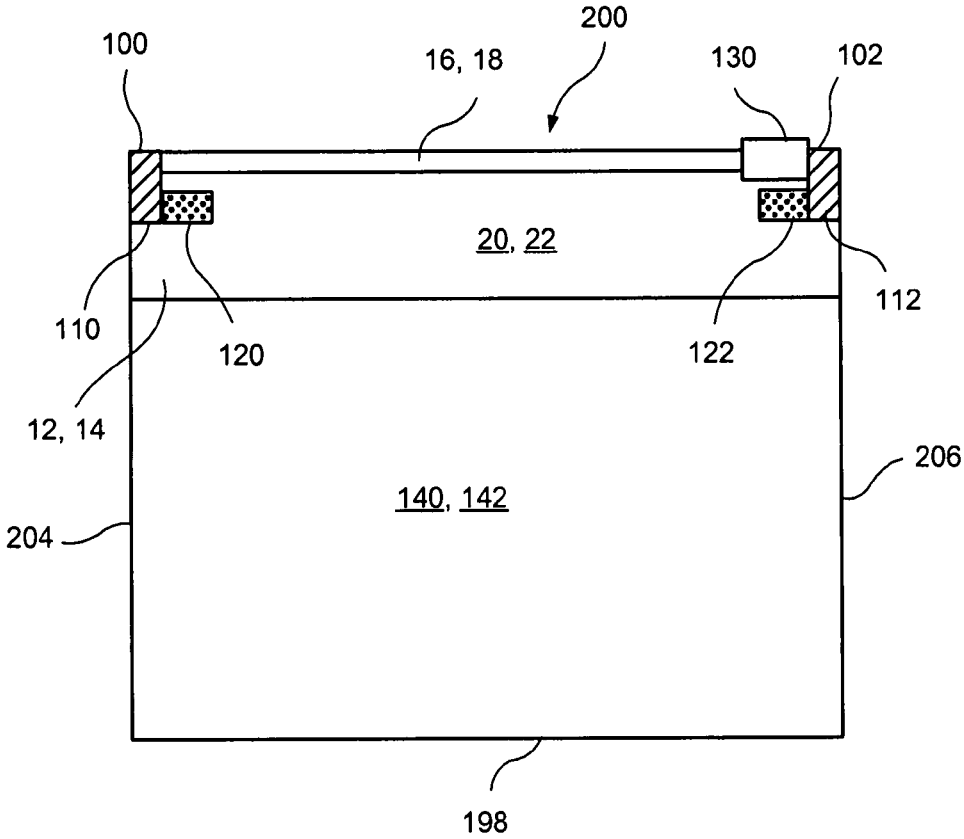
FIG. 7 is a side plan view of a single reclosable package or bag, illustrating the slider positioned above the cross element of the endstop, thereby shielding the slider from the force of the distension of the package or bag walls.
Figure 8:
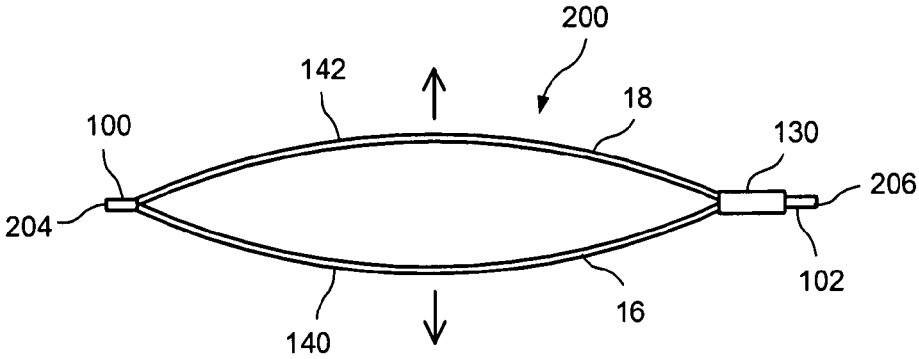
FIG. 8 is a top view of the single reclosable package or bag illustrated in FIG. 7.

FIGS. 7 and 8 illustrate the individual package or bag 200 with the slider 130 toward the end of the zipper 10, positioned above the lower cross element 122. As the front and rear package or bag walls 140, 142 are fused together in the lower cross element 122, any separation or distension of the package or bag walls 140, 142, such as due to the opening of the package or bag 200 (see FIG. 8) will not exert significant prying forces on the slider 130 to separate the slider 130 from the zipper 10.

Figure 9:
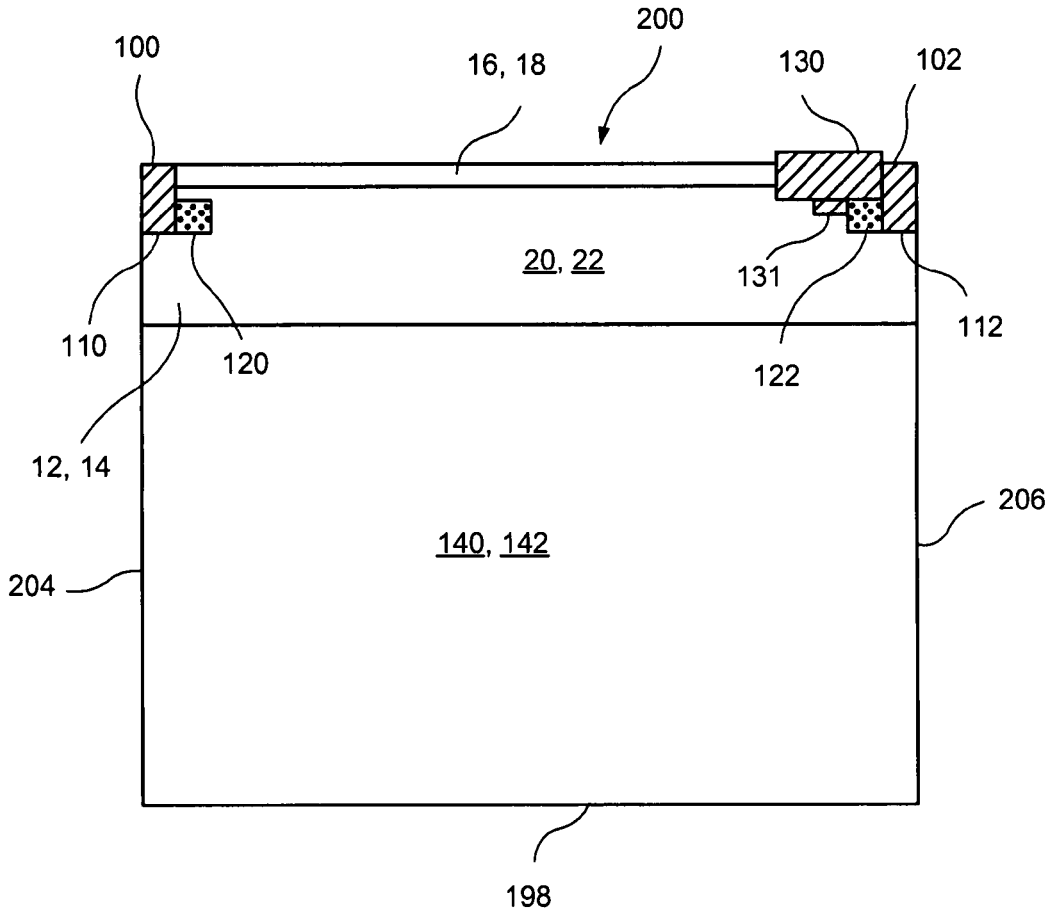
FIG. 9 is a plan view of an alternative embodiment of the reclosable package or bag wherein the slider plow abuts the endstop.

FIG. 9 illustrates an alternative embodiment wherein slider 130 includes separating plow 131 which abuts against the inner vertical face of lower cross element 122 when slider 130 is in the rightmost position. This additional contact significantly increases the force required to pull slider 130 from the end of the zipper in the horizontal direction.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A length of zipper material for reclosable packages or bags, including:

first and second interlocking profiles including respective first and second interlocking elements and respective first and second bag wall engaging flanges, wherein the first and second bag wall engaging flanges are attached to an exterior of the respective first and second interlocking elements, whereby the first and second bag wall engaging flanges are configured and arranged to connect the first and second interlocking elements to respective first and second bag walls;

at least one slider mounted on the first and second interlocking elements;

a plurality of endstops formed on the length of zipper wherein a portion of the first and second interlocking profiles are fused together, the endstops having the shape of an inverted T;

wherein the shape of the inverted T includes a stem perpendicular to the interlocking elements and at least one cross element parallel to the interlocking elements;

wherein the stem includes a portion where the first and second interlocking elements are crushed;

wherein the at least one cross element is immediately below a lower surface of the slider and includes at least a portion wherein the first and second bag wall engaging flanges are fused together at a position separated from and below the interlocking elements thereby minimizing prying forces on the slider when a load is exerted on the first and second bag wall engaging flanges.

2. The length of zipper material of claim 1 wherein the length of zipper material is separated into zipper segments at the mid-point of the endstops thereby providing a first separated endstop in the shape of an L at a first end of the zipper segments and a second separated endstop in the shape of a reversed L at a second end of the zipper segments.

3. The length of zipper material of claim 2 wherein the zipper segments are separated into zipper segments at package-width intervals.

* * * * *